United States Patent [19]

Varel, Sr.

[11] Patent Number: 4,763,736

[45] Date of Patent: Aug. 16, 1988

[54] ASYMMETRICAL ROTARY CONE BIT

[75] Inventor: Daniel W. Varel, Sr., Dallas, Tex.

[73] Assignee: Varel Manufacturing Company, Dallas, Tex.

[21] Appl. No.: 71,157

[22] Filed: Jul. 8, 1987

[51] Int. Cl.[4] ..... E21B 10/16

[52] U.S. Cl. ..... 175/341; 175/353; 175/376; 175/378

[58] Field of Search ..... 175/331, 341, 343, 350, 175/353, 356, 369, 376, 378, 410

[56] References Cited

U.S. PATENT DOCUMENTS

| | | | |
|---|---|---|---|
| 1,306,674 | 6/1919 | Esseling | 175/376 X |
| 2,057,026 | 6/1935 | Harrington | 175/356 |
| 2,107,626 | 2/1938 | Catland | 175/355 |
| 2,107,665 | 2/1938 | Harrington | 175/378 X |
| 2,148,372 | 2/1939 | Garfield | 175/341 |
| 2,184,067 | 1/1939 | Zublin | 175/340 |
| 2,463,932 | 3/1949 | Zublin | 175/353 |
| 3,142,347 | 7/1964 | Barnes | 175/349 |
| 3,397,751 | 8/1968 | Reichmuth | 175/341 |
| 3,656,764 | 4/1972 | Robinson | 175/371 X |

*Primary Examiner*—Jerome W. Massie, IV

*Assistant Examiner*—William P. Neader

*Attorney, Agent, or Firm*—Harold E. Meier

[57] ABSTRACT

Improvement in the drilling of vertical bore holes is achieved by an asymmetrical rotary cone bit having a substantially cylindrical body with a shank formed on the body and extending therefrom along a vertical axis for connection to a drill string. Projecting from the cylindrical body are three journal pins, which pins extend from the end of the body opposite from the shank. These three journal pins are circumferentially displaced such that the rotational axis of the first and second pins are displaced more than 120 degrees and less than 180 degrees. The axis of the third journal pin is circumferentially displaced equidistant from the axis of the other two journal pins. Journaled on the first and second journal pins are first and second roller cutter cones having substantially the same based diameter. Each of these cutter cones has cutting teeth extending from the surface thereof and includes a row of gage cutting teeth. A gage roller cone having a smaller base diameter than the first and second roller cones, is journaled on the third journal pin and includes a row of gage cutting teeth.

8 Claims, 2 Drawing Sheets

ASYMMETRICAL ROTARY CONE BIT

TECHNICAL FIELD

This invention relates to a rotary cone bit, and more particularly, to a rotary cone bit having an asymmetrically arranged positioning of the cutter cones.

BACKGROUND ART

Rolling cutter bits of a conventional three-cone design are extensively used in the drilling of bore holes for hydrocarbon production. The usual design of a rolling cutter bit consists of three cone shaped cutters each journaled to rotate about a journal pin. Each of the journal pins is equally spaced, 120 degrees apart, with the three pins mounted to a bit body. The entire structure is rotated at the end of a drill string. While an asymmetrical three cone rock bit with unequal sized cones is known, for example, see U.S. Pat. No. 3,397,751, for the more usual case, all three cones of a bit are the same size and have the same base diameter.

A reoccurring problem of the drilling industry is the deviated or crocked bore hole that results when the drill bit encounters formations that are not horizontal. Ideally, the bore hole should be vertical or substantially vertical. However, the encountering of non-horizontal formations often results in a deviation from the vertical. Undesirable deviation has also been known to result when the drill bit strikes a buried obstacle or by the passage of the drill bit from one strata to another strata having a different degree of density. A deviated bore hole not only increases the cost of drilling, but also has been known to cause the bore hole to bypass the productive sands.

Some of the early drill bits used for drilling bore holes for hydrocarbon production consisted of two rotary cutter cones each journaled to rotate on a journal pin, where the journal pins were equidistant from each other circumferentially. Although it is recognized that the three cone rotary rock bit is the most efficient arrangement under most drilling conditions, it has been found that the two-cone bit will tend to bring a deviated bore hole back to a vertical alignment more effectively than a three-cone bit. The two-cone bit has been found to take advantage of the pendulum effect which is the natural tendency of a bit suspended from a drilling rig at the earth's surface by a drill string to seek a vertical position. Thus, the two-cone bit provides a more efficient device for correcting a deviated bore hole. However, the conventional two-cone bit has the tendency to set up drill string vibrations with destructive effects on the surface equipment.

The three cone rotary rock bit is recognized as having many advantages, including the minimization of vibration of the drill string. In accordance with the present invention there is provided an asymmetrical rotary cone bit that has the advantages of a two-cone bit to minimize deviation or correct bore hole deviation, and the advantages of a three-cone bit including the minimization of drill string vibration. Previous attempts to provide the advantages of a two-cone bit and advantages of the three-cone bit are known in the prior art, for example, see U.S. Pat. No. 3,142,347.

For each revolution of the two-cone bit there is one less cone in contact with the wall of the bore hole which makes the bit more responsive to the "pendulum effect." While this pendulum effect has the tendency of maintaining a vertical bore hole, the resistance to gage wear in the two-cone bit is reduced to two-thirds that of the conventional three-cone rotary drill bit. As mentioned, the two-cone bit will run much rougher than a three-cone rotary drill bit with excessive vibrations to the upstream equipment. However, the two-cone bit is more effective because by enabling the use of larger cones, less weight is needed for penetration of the rock strata.

In accordance with the present invention, there is provided an asymmetrical rotary cone bit that utilizes the larger cones of the two-cone bit but provides a third cone to achieve the advantages of the three-cone bit. Thus the asymmetrical cone bit of the present invention approaches the two-cone structure with two large cones for the pendulum effect, while retaining the advantages of the three-cone rotary bit to hold the gage dimension.

A further advantage of the two-cone bit is that it enables the use of substantially larger bearings with correspondingly longer bit life and further increases the number of cutting teeth per cone which also increases bit life. It is well recognized in the drilling industry that any increase in bit life substantially reduces overall drilling costs by reducing the number of "trips" of the drill string from the bore hole to change bits.

DISCLOSURE OF THE INVENTION

In accordance with the present invention, there is provided an asymmetrical rotary cone bit having a substantially cylindrical bit body with a shank formed about a vertical axis for connection of the bit to a drill string. Included as part of the bit body are three journal pins extending from the end of the body opposite from the shank. Each journal pin has an axis of rotation with the axis of the first and second pins circumferentially displaced more than 120 degrees and less than 180 degrees. The axis of the third journal pin is circumferentially displaced equidistant from the axis of the other two journal pins. Journaled to rotate on the first and second journal pins are first and second roller cutter cones each having substantially the same base diameter. Each of these cutter cones is equipped with cutting teeth extending from the surface thereof and including a row of gage cutting teeth. Further, the cone bit of the present invention includes a gage roller cone having a smaller base diameter than the first and second roller cutter cones and journaled to rotate on the third journal pin. The gage roller cone has cutting teeth only along a gage row.

Further in accordance with the present invention, the above described asymmetrical rotary cone bit includes first and second roller cutter cones having a base diameter selected to enable the cutting teeth of each cutter cone to project between the cutting teeth of the other cone.

There also is provided in accordance with the present invention, an asymmetrical rotary cone bit as described above with the axis of the first and second journal pins passing through the vertical axis of the bit body at substantially the same location, and the axis of the third journal pin passing through the vertical axis at a location further displaced from the bit body than the location of the first and second journal pins.

BRIEF DESCRIPTION OF THE DRAWINGS

For a more complete understanding of the present invention and the advantages thereof, reference is now made to the following description taken in conjunction with the accompanying drawings in which.

DETAILED DESCRIPTION

Figure 1:
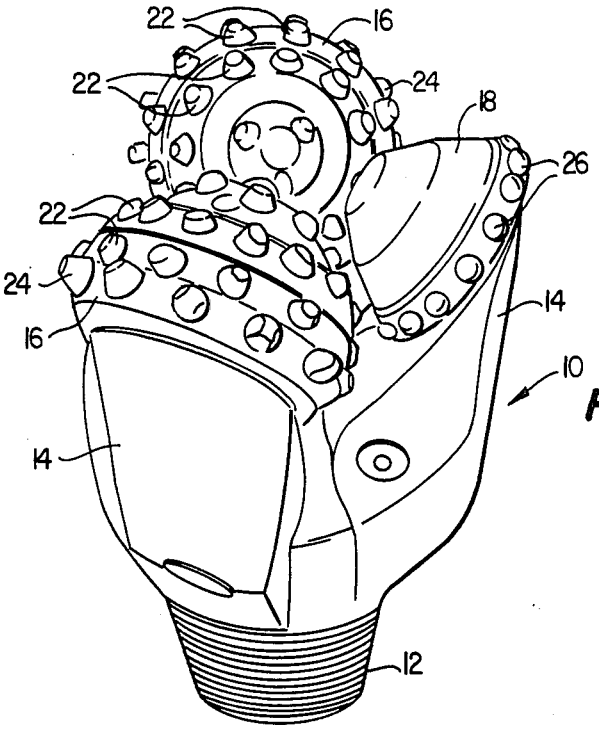
FIG. 1 is a pictorial view of an asymmetrical rotary cone bit having two rolling cutter cones and a gage roller cone.

Referring to FIG. 1, there is shown an asymmetrical rotary cone bit including a bit body 10 having at one end a threaded shank 12 for attachment to a suitable drill string collar of a tool joint (not shown). The shank portion 12 is adapted to be threadedly engaged with a drill string in accordance with conventional drill bit construction. Extending from the bit body 10 are three leg portions 14 providing supporting elements for rotatably supporting on bearing structure of a journal pin roller cutter cones 16 and a gage roller cone 18. Both the bit body 10 and the shank 12 have axially extending hollow passages (not shown) to permit passage of drilling fluid to flush the bore hole of debris during the drilling operation. These passages terminate at nozzles 10 in accordance with conventional drill bit construction.

As illustrated in FIG. 1, the roller cutter cones 16 have substantially the same base diameter 16*a* with the diameter selected to permit the cutting teeth on each cone to project between the cutting teeth of the other cutter cone. The cutting teeth on each of the cutter cones 16 are arranged in rows and in the embodiment shown comprise tungsten carbide inserts press fit into the cone surface and projecting therefrom. Each of the cutter cones 16 is also provided with gage row cutting teeth 22 such as carbide inserts press fit into the cone surface and projecting therefrom.

The gage roller cone 18 is also journaled for rotation on a leg portion 14 and has a generally conical shaped configuration. The base diameter of the gage roller cone 18 is selected to be smaller than that of the roller cutter cones 16. At the base of the gage cone 18, there is provided a row of gage cutting teeth 26 shown as carbide inserts press fit into the surface of the cone and projecting therefrom along the gage row. The gage roller cone is provided with only the row of gage cutting teeth 26 and is not provided with additional cutting teeth as illustrated for the roller cutter cones 16.

Each of the roller cutter cones 16 and the gage roller cone 18 are journaled on respective leg portions 14 for rotation about a rotational axis of a journal pin. This axis of rotation is inclined with respect to the vertical axis of the bit in accordance with conventional roller cone cutter technique.

The bearing structure and seal assembly in each of the cutter cones 16 and the gage cone 18 is of a conventional design and will be further described with reference to FIG. 3.

Figure 2:
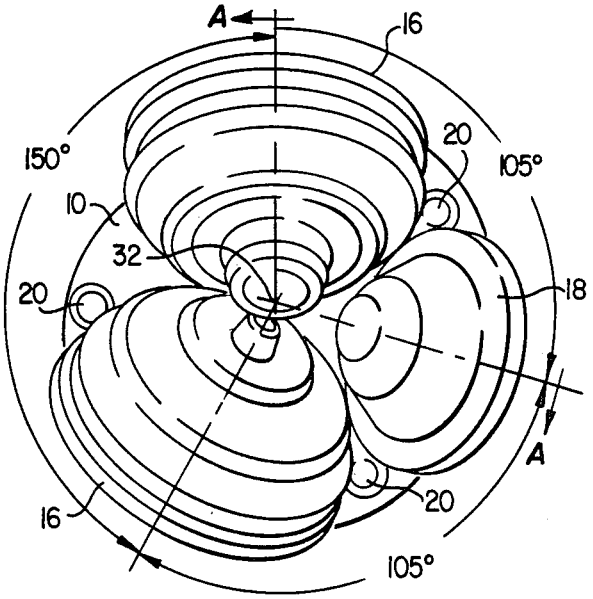
FIG. 2 is a top view of the asymmetrical rotary cone bit of FIG. 1 illustrating the circumferential displacement of the two roller cutter cones and the gage roller cone.

Referring to FIG. 2, there is shown a top view of the asymmetrical rotary cone bit of FIG. 1 including the roller cutter cones 16 and the gage roller cone 18. The axis of rotation of each of the roller cutter cones 16 is identified by the reference numeral 28 and the axis of rotation of the gage roller cone is identified by the reference numeral 30. Each of these axis intersects at a point 32 which coincides with the vertical axis through the bit body 10. As previously discussed, the base diameter of the roller cutter cones 16 is selected such that the projecting cutting teeth from each cone surface project into the cutting teeth of the other cone. The gage roller cone 18 is equipped with only gage cutting teeth 24 and therefore there is no interaction of the roller cutter cones with the gage roller cone.

As the name implies, the gage roller cone 18 serves to maintain the gage dimension of the bore hole in conjunction with the gage cutting teeth of the roller cutter cones 16. The drill bit as described functions basically as a two cone bit and as such the resistance to gage wear is reduced to two-thirds that of the conventional three cone rotary drill bit. To maintain the desired gage dimension of a bore hole, the gage roller cone 18 is positioned on the bit body such that its cutting teeth are at the same radius from the vertical axis as indicated by the point 32, as the cutting teeth on the gage row for the cutters 16. Since it has been found that a two cone rotary bit will run much rougher than a conventional three cone rotary bit causing excessive vibrations, the gage roller cone 18 also provides a degree of stability to the rotary bit of the present invention.

Circumferential displacement of the rotational axis for the cutter cones of a conventional three cone bit is 120 degrees. For a two cone bit the rotational axis of each cone is displaced 180 degrees. In accordance with the present invention, the rotational axis 28 of each of the rotary cutter cones 16 is circumferentially displaced within the range of between 120 degrees and 180 degrees. The rotational axis of the gage roller cone 18 is displaced circumferentially equidistant between the rotational axis for each of the rotary cutter cones 16. As illustrated in FIG. 2, the axis 28 of the rotary cutter cones 16 is circumferentially displaced 150 degrees and the circumferential displacement between each axis 28 and the axis 30 for the gage roller cone 18 is 105 degrees.

Figure 3:
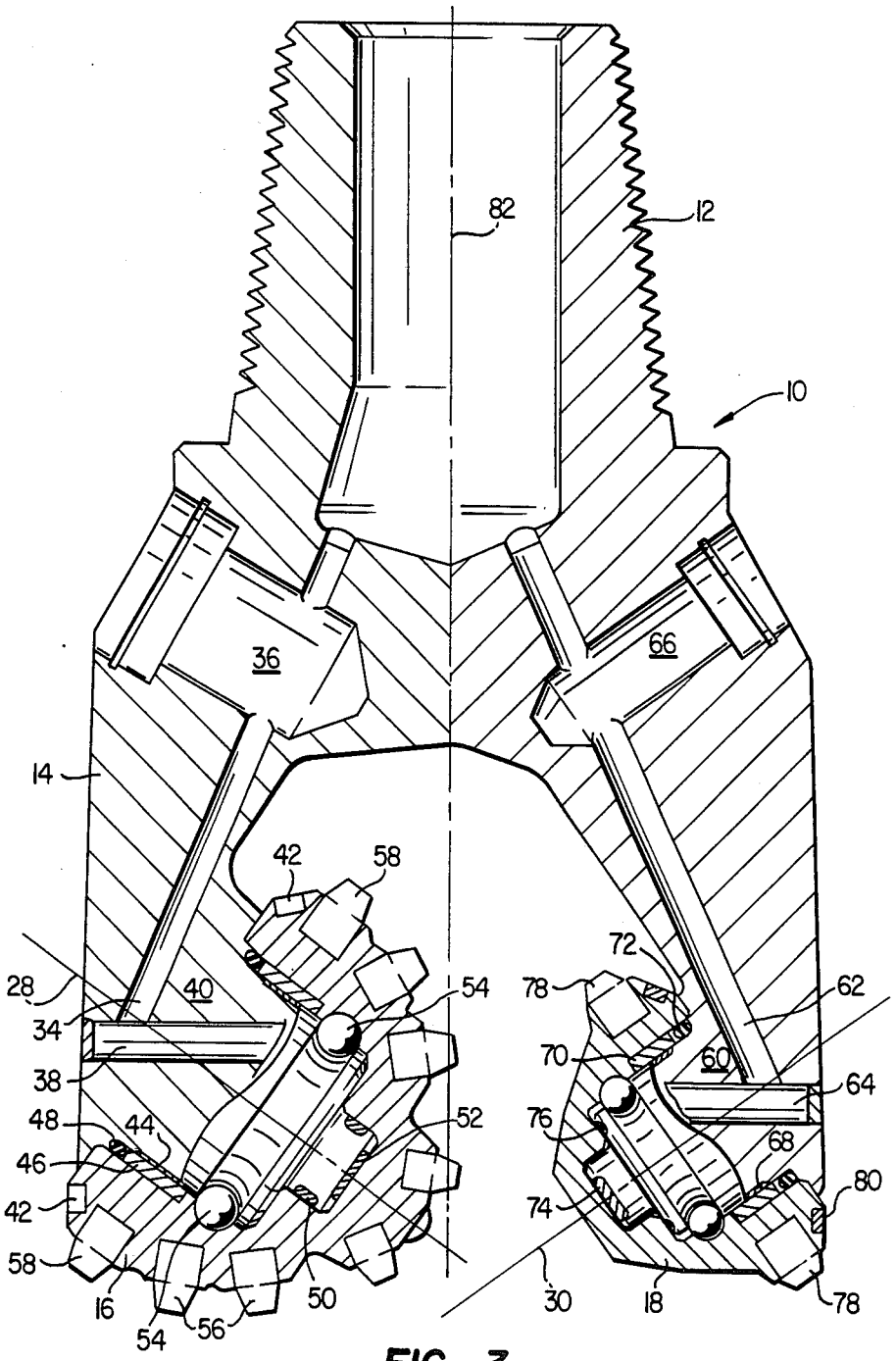
FIG. 3 is a section taken along the lines A—A of FIG. 2 illustrating the mounting of one of the roller cutter cones and the gage roller cone.

Referring to FIG. 3, there is shown a sectional view of the asymmetrical rotary drill bit of the present invention taken along the line A—A of FIG. 2. This figure illustrates in section only one of the roller cutter cones 16. Two of the circumferentially spaced leg portions 14 are illustrated in FIG. 3 on the end of the bit body opposite from the shank 12. Included as part of the leg portion 14 supporting the cone 16 is a lubrication system including a passage 34 and a lubrication reservoir 36. The passage 34 communicates with a passage 38 having an opening into the cavity formed between a journal pin 40 and the inside surface of the cutter cone 16. An annular shaped wear ring 44 is assembled onto the journal pin 40 in a location opposing a sleeve bearing 46 pressed fit into the body of the cone 16. In an annular groove formed by assembly of the cutter cone 16 onto the journal pin 40 there is provided a seal 48 to inhibit the contamination of the lubricant within the cavity as previously described. Also assembled onto the journal pin 40 is a wear ring 50 and a thrust plate 52. In accordance with conventional techniques, to hold the cutter cone 16 onto a journal pin 40 there is assembled two a toroidal shaped channel a plurality of spherical shaped retaining balls 54.

Extending from the surface of the cutter cone 16 are a plurality of cutting teeth 56 that as explained previously project between the cutting teeth of the second roller cutter cone 16. However, as illustrated in FIG. 3, the cutting teeth 56 of the cutter cone 16 do not extend to the surface of the gage cutter cone 18. Along the gage row of the cutter cone 16 there is positioned cutting teeth 58 that also project from the surface of the body of the cone. Press fit into the cone 16 are flat head inserts 42 spaced along a wear surface. As illustrated, the general configuration of the cutter cone 16 is hemispherical and has a base diameter measured at the gage row.

Journaled to rotate about a journal pin 60 as part of the leg portion 14 is the gage cutter cone 18. Within the leg portion 14 and extending into a journal pin 60 is a lubrication passage 62 opening into a passage 64. Lubrication is provided into the passage 62 from a lubrication reservoir 66. The details of the lubrication systems for the roller cutter cones 16 and the gage cutter cone 18 are not detailed. Such lubrication systems are well known in the art of drill bit design.

To journal the gage cutter cone 18 to rotate on the journal pin 60 there is provided bearing surfaces similar to that described with reference to the journal pin 40. Thus, there is assembled onto the journal pin 60 an annular shaped wear ring 68 that is located opposite from a sleeve bearing 70 press fit into the body of the gage cutter cone 18. With the gage cutter cone 18 assembled onto a journal pin 60, there is formed an annular channel in which is assembled a seal ring 72. Also forming a part of the assembly for supporting the cutter cone 18 on the journal pin 60 are thrust bearings including a disc bearing 74 and a circular shape thrust bearing 76, both formed into the end surface of the journal pin 60.

The overall configuration of the gage cutter cone 18 is hemispherical terminating at its base in a row of gage cutting teeth 78 projecting from the surface of the cone body. Also press fit into the body of the gage cutter cone 18 are flat head inserts 80.

As illustrated in FIG. 3, the rotational axis of the roller cutter cone 16 and the rotational axis 30 of the gage cutter cone 18 intersects the vertical axis 82 of the cone body at different locations along the axis. Specifically, the rotational axis 28 intersects the vertical axis 82 at a point closer to the cone body than the rotational axis 30 of the gage cutter cone 18. That is, the rotational axis 28 of both roller cutter cones 16 pass through the vertical axis 82 of the bit body at substantially the same location while the rotational axis 30 of the gage cutter cone 18 passes through the vertical axis 82 at a location displaced from the bit body more than the location of the rotational axis 28. This configuration of the rotational axes 28 and 30 positions the cutting teeth of the roller cutter cones 16 at the same radial distance from the vertical axis 82 as the gage cutting teeth 78 of the gage cutter cone 18. Thus, as the bit rotates about the axis 82, the gauge teeth 58 and 78 traverse the same circular path about the axis 82.

In operation, the asymmetrical two-cone bit of the present invention provides the advantages of the conventional two-cone bit, that is, for each revolution of a bit, there is one less cone in contact with the bore hole wall which produces a "pendulum effect." When the asymmetrical roller cone bit as described herein is suspended in the bore hole during a drilling operation, the weight of the bit and the drill collars will result in the tendency to bring the bit to the vertical center of the drill string with the result that the bit has a tendency to bore a more vertical hole than a three cone bit. The asymmetrical bit of the present invention, which is effectively a two-cone bit, reduces the tendency in certain formations for the hole to deviate from the vertical when compared to the conventional three cone rotary bit. This is because of the fewer contacts with the wall of the bore hole per revolution and also less weight is needed on the drill string for penetration. With the utilization of the gage cutter cone 18, the stability advantages of a three cone rotary bit are retained, that is, excessive vibrations experience with two cone bits are minimized and the gage dimension is held.

Although a preferred embodiment of the invention has been illustrated in the Drawings and described in the foregoing Detailed Description, it will be understood that the invention is not limited to the embodiment disclosed but is capable of numerous rearrangements, modifications and substitutions of parts, dimensions, and elements without departing from the spirit of the invention.

I claim:

1. An asymmetrical rotary cone bit, comprising: a substantially cylindrical bit body having a shank formed by a vertical axis for connection to a drill string and including three journal pins extending from the end of the body opposite from the shank, each journal pin having a rotational axis passing through the vertical axis of the bit body with the rotational axis of the first and second journal pins passing through the vertical axis of the bit body at substantially the same location along the vertical axis, with the axis of the third journal pin passing through the vertical axis at a location further displaced from the bit body than the location of the axis for the first and second journal pins, and with the rotational axis of the first and second of the journal pins circumferentially displaced more than 120 degrees and less than 180 degrees and the axis of the third journal pin circumferentially displaced equidistant from the axis of the other two journal pins;

first and second roller cutter cones of substantially the same base diameter and journaled to rotate on the first and second journal pins, respectively, each of said cutter cones having cutting teeth extending from the surface thereof and including gage row cutting teeth; and a gage roller cone having a smaller base diameter than the first and second roller cones and journaled on the third journal pin, said gage roller cone having cutting teeth only along a gage row.

2. An asymmetrical rotary cone bit as set forth in claim 1 wherein the rotational axis of the first and second journal pins are circumferentially displaced between 135 degrees and 150 degrees.

3. An asymmetrical rotary cone bit as set forth in claim 1 wherein the base diameter of the first and second roller cutter cones is selected to enable the cutting teeth of each cutter cone to project between the cutting teeth of the other cutter cone.

4. An asymmetrical rotary cone bit, comprising:

a substantially cylindrical bit body having a shank formed by the vertical axis for connection to a drill string and including three journal pins extending from the end of the body opposite from the shank, each journal pin having a rotational axis passing through the vertical axis of the bit body with the axis of the first and second journal pins passing through the vertical axis of the bit body at substantially the same location along the vertical axis, with the axis of the third journal pin passing through the vertical axis at a location further displaced from the bit body than the location of the axis for the first and second journal pins, and with the rotational axis of the first journal pin circumferentially displaced from the axis of the second journal pin substantially not less than 150 degrees and the axis of the third journal pin circumferentially displaced substantially not less than 105 degrees from the axis of the first and second journal pins;

first and second roller cutter cones having substantially the same base diameter and journaled to rotate on the first and second journal pins, respectively, each of said cutter cones having cutting teeth extending from the surface thereof and including gage row cutting teeth; and a gage roller cone having a smaller base diameter than the first and second roller cones and journaled to rotate on the third journal pin, said gage roller cone having cutting teeth only along a gage row.

5. An asymmetrical rotary cone bit as set forth in claims 4 wherein the base diameter of the first and second roller cutter cones is selected to enable the cutting teeth of each cone cutter to project between the cutting teeth of the other cone cutter.

6. An asymmetrical rotary cone bit as set forth in claim 4 including a bearing seal for each of the journal pins disposed between a bearing surface of each pin and a bearing surface of each roller cone.

7. An asymmetrical rotary cone bit as set forth in claim 6 wherein the cutting teeth of the first and second roller cutter cones are formed from a hardened steel and integral with the cone surface.

8. An asymmetrical rotary cone bit as set forth in claim 6 wherein each of the cutting teeth of the roller cones comprises a press fit insert of a carbide material.

* * * * *